US006156088A

United States Patent [19]

Cardarelli

[11] Patent Number: 6,156,088

[45] Date of Patent: Dec. 5, 2000

[54] PURE AIR SYSTEM

[76] Inventor: Venanzio Cardarelli, 20 N. Triangle Dr., Plymouth, Mass. 02360

[21] Appl. No.: 09/289,696

[22] Filed: Apr. 9, 1999

Related U.S. Application Data

[60] Provisional application No. 60/081,568, Apr. 13, 1998.

[51] Int. Cl.[7] ..... A24F 19/10

[52] U.S. Cl. ..... 55/385.8; 55/471; 55/486; 96/55; 96/63; 96/227; 131/231; 131/238; D27/108; D27/119

[58] Field of Search ..... 55/385.8, 486, 55/471; 96/55, 63, 226, 227; 131/231, 238; D27/108, 119

[56] References Cited

U.S. PATENT DOCUMENTS

| | | | |
|---|---|---|---|
| D. 219,187 | 11/1970 | Boykin | D27/108 |
| 2,769,219 | 11/1956 | Elkavich | 131/238 X |
| 3,797,205 | 3/1974 | Weisskopf | 131/238 X |
| 3,860,404 | 1/1975 | Jochimski | 131/238 X |
| 3,966,442 | 6/1976 | Waters | 131/231 X |
| 4,043,776 | 8/1977 | Orel | 55/385.8 X |
| 4,082,872 | 4/1978 | Hughes | 131/231 X |
| 4,231,379 | 11/1980 | Kohori | 131/238 X |
| 4,623,367 | 11/1986 | Paulson | 55/385.8 |
| 4,671,300 | 6/1987 | Grube et al. | 131/231 |
| 4,732,591 | 3/1988 | Tujisawa et al. | 131/231 X |
| 5,088,508 | 2/1992 | Duncan | 55/385.8 X |
| 5,562,286 | 10/1996 | Brinket | 131/231 X |

*Primary Examiner*—Richard L. Chiesa
*Attorney, Agent, or Firm*—D. Michael Burns

[57] ABSTRACT

A smoke and odor purifying system which can be incorporated within a housing that can serve both as a table centerpiece and an ashtray. The system having an esthetically pleasing flower vase construction with petal shaped appendages for resting of cigarettes or the like. A floral arrangement is made up of individual artificial flowers. Each flower having an opening in the bud for drawing in smoke-filled air and passing it through the system. Also defined within the petals of the housing are a plurality of intake openings through which cigarette smoke, as well as secondary smoke from the surrounding area may be drawn downwardly through the device. An electrically or battery powered fan means, positioned below a filtration and odor-treatment system, drives the smoke through the system which includes an electrostatic prefiltering bed followed by an activated charcoal bed, an H.E.P.A. filter and finally another activated charcoal bed containing an air freshening material. Refreshed and smoke free air is returned to the surrounding atmosphere through a plurality of exhaust vents located at the bottom of the housing.

15 Claims, 3 Drawing Sheets

PURE AIR SYSTEM

CROSS REFERENCE TO RELATED APPLICATION

This application is based on Provisional Patent application Ser. No. 60/081,568 filed Apr. 13, 1998.

BACKGROUND OF THE INVENTION

1. Field of the Invention

The present invention relates generally to devices for removing and purifying air. More particularly, an ashtray that can be used as a table centerpiece as well as a vase for holding flowers.

2. Description of the Prior Art

The prior art is well proliferated with numerous attempts to provide effective air cleaning and odor masking ashtrays. Most of these devices use a fan to draw in secondary air, filter out the impurities, then clean the air before returning it to the room both scented and refreshed. To many non-smokers, the smell of cigarette smoke is extremely unpleasant and can be in some cases actually nauseating. The Surgeon General has determined that cigarette smoking is dangerous to one's health, and that secondary smoke can actually be more hazardous than primary smoke. In fact much of the smoke emanating from a cigarette is generated not while the cigarette is actually being smoked, but while the cigarette is at rest in an ashtray. This smoke permeates the environment of the area and is a major problem. Restaurants have, usually by local ordinances, smoking and non-smoking sections. Not many establishments have voluntarily adopted a totally non-smoking policy for fear of losing a substantial customer base. The non-smoking sections do not usually solve the problem, since the secondary smoke will flow to all areas of the room. Thus, there is a need to have the polluted air removed from the nearby area, hopefully by an esthetically pleasing device.

U.S. Pat. No. 3,797,205 issued to Weisskopf on Mar. 19, 1974, teaches the use of an ashtray with a filter system including air intake ducts for inhaling air. This device is extremely bulky and is not very esthetic. Unlike the present invention, it would not likely be employed as a centerpiece.

U.S. Pat. No. 3,966,442 issued to Waters on Jun. 29, 1971, discloses an odor masking and filtering ashtray. While Waters teaches multiple ports for drawing in smoke, it would hardly be suitable as a centerpiece.

U.S. Pat. No. 4,231,379 issued on Nov. 4, 1980 to Kohori, actually discloses an ashtray that will accept a cigarette within an aperture and thereby trapping the smoke. While Kohori teaches that this device can be decorative and can hold flowers, he does not teach of a device that attempts to treat the general secondary smoke around the occupants of the table. Kohori does not teach the use of any fan system to inhale the smoke.

U.S. Pat. No. 4,671,300 issued to Grube et al. on Jun. 9, 1987, teaches a smokeless ashtray that is battery powered. Grube et al. utilizes an air filter, preferably a multistage filter including activated charcoal. This device does not address the most important need, that is to ensure that it will be used. It will not be sufficiently utilized if it is not esthetically pleasing enough to encourage its use in a restaurant. The present invention seeks to solve this problem by providing an esthetically pleasing ashtray, one which can also serve as a flower vase centerpiece.

U.S. Pat. No. 4,732,591 issued to Tujisawa et al. on Mar. 22, 1988, discloses an air cleaning apparatus that has an esthetically pleasing appearance, that of a flower pot. A fan is disposed inside the container as is a filter. This air cleaning device addresses the need for cleaning the surrounding air, but it does not teach any means for handling lit cigarettes whereby the smoke from them is inhaled and cleaned.

U.S. Pat. No. 5,562,286 issued to Brinket on Oct. 8, 1996, discloses the use of a ventilating device for removing secondary smoke at the top of a gambling table. Fans inhale the smoke and then purify, clean and return refreshed air to the room. This device does not teach any way for it to be used as a centerpiece, especially in a public place where esthetics would be very important.

None of the above inventions and patents, taken either singly or in combination, is seen to describe the instant invention as claimed.

SUMMARY OF THE INVENTION

The present invention is directed to a pure air system which may be used as an ashtray, and has an esthetically pleasing appearance that will allow it to be used as a centerpiece or a decoration that will hold flowers or the like. It could also be an ornamental floor decoration that would hold bushes, ferns, trees or other garden type articles.

The ashtray will have petal arms extending radially away from a center channel which will hold flowers, real or artificial. The crevices between the petals define concave surfaces which are used to hold lit cigarettes. Each petal has a ventilation opening for inhaling secondary smoke. This smoke is driven through a neck portion of the ashtray, then downwardly through a multibed fitration system comprising: a prefiltering layer; activated charcoal; H.E.P.A. filter; and then another activated charcoal bed which will contain an odor refreshener. In the preferred embodiment, the flowers will be artificial, and will each have a air intake, removable prefilter and hollow construction that will allow the polluted air to be taken in through them and processed as above. The driving force is fan generated which can be powered either electrically or by battery. The base contains multiple ports for returning the filtered and refreshed air to the room. The device has a non-skid and removable rubber-like pad which will absorb vibrations caused by the motor. The pad can be removed when the device needs to be opened for cleaning and replacement of interior parts.

An alternate embodiment would have the system be a floor standing type device which would operate along the same principles of the main embodiment. However, these units would have the capability the be connected to a air conditoning outlet to provide a superior driving power.

Accordingly, it is a principal object of the invention to provide a smoke free ashtray that is esthetically pleasing enough to be used as a table centerpiece.

It is another object of the invention to provide an ashtray that can be used a flower vase.

It is a further object of the invention to provide an ashtray that can be battery powered.

Still another object of the invention is to provide an ashtray that will not only clean and purify the smoke emanating from the lit cigarette resting on it, but also will purify the surrounding air and return the same freshly scented.

It is an object of the invention to provide a device which may be used with a variety of shrubs, plants and ornamental trees, all having air entrance ports whereby the surrounding air can be cleaned and returned to the immediate atmosphere.

Still another object of the invention is to provide a device for the purposes described which is inexpensive, dependable and fully effective in accomplishing its intended purposes.

These and other objects of the present invention will become readily apparent upon further review of the following specification and drawings.

Similar references characters denote corresponding features consistently throughout the attached drawings.

DETAILED DESCRIPTION OF THE PREFERRED EMBODIMENT

In restaurants and other public places where there are smoking and non-smoking areas, it is imperative to cleanse the secondary air. This is necessary because smoke infiltrates every area of a room, even the non-smoking area.

Figure 1:
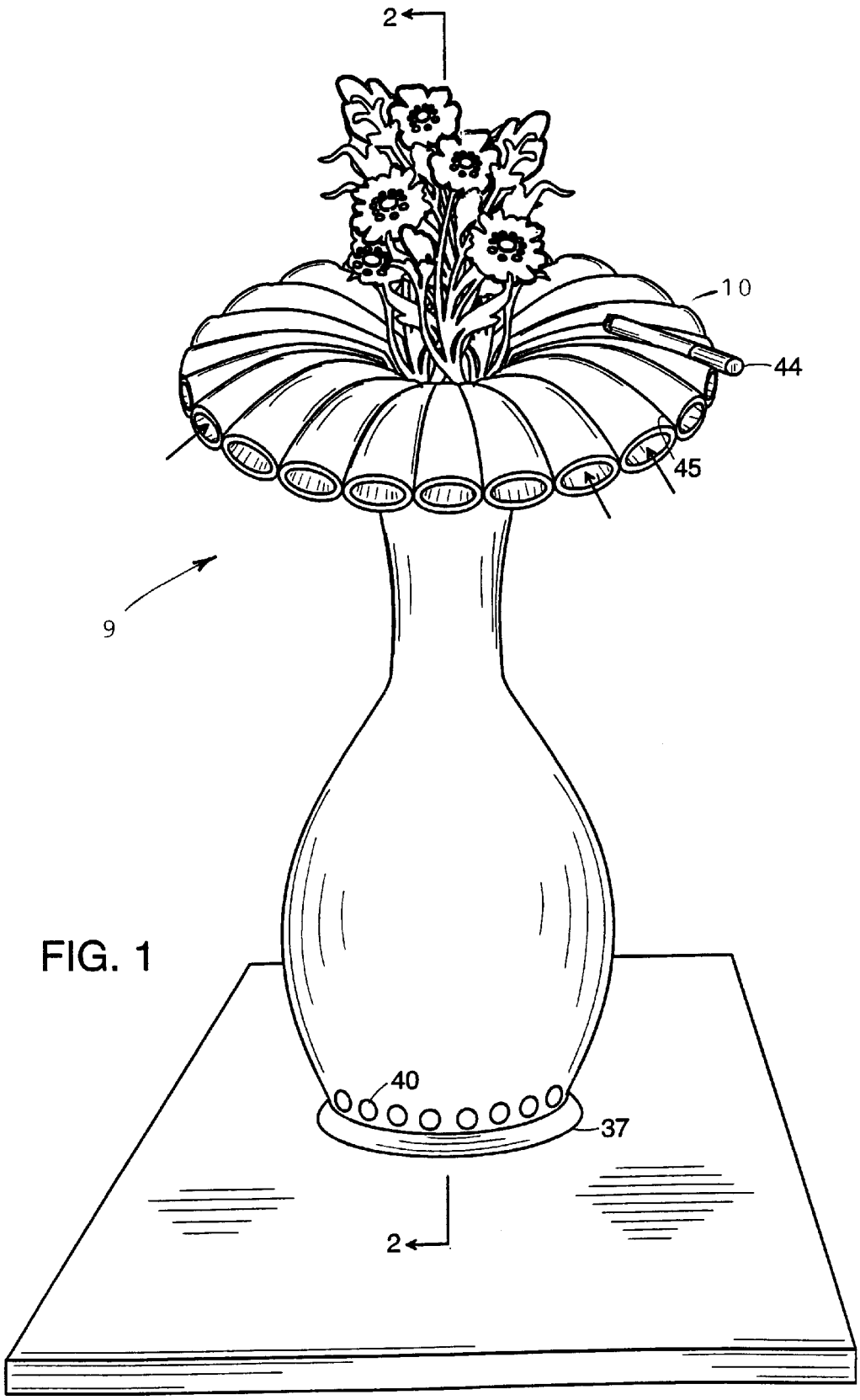
FIG. 1 is an environmental view of the invention.
Figure 2:
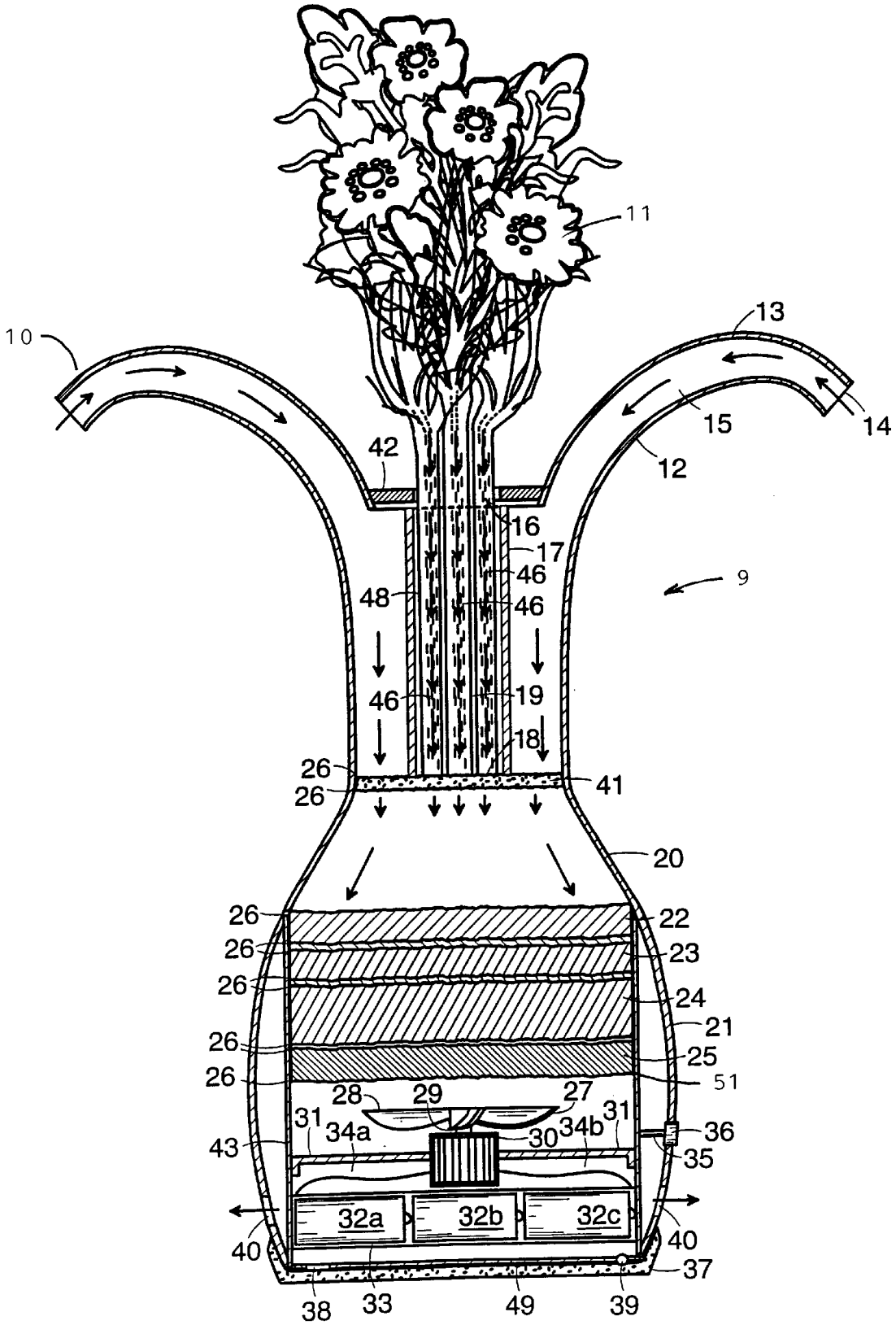
FIG. 2 is an elevational view of the invention, with the rear and side being symmetrical.

Referring to FIGS. 1–2, an ashtray housing 10 of the pure air system invention 9 is depicted generally as a hollow, ornamental vase-like housing 10 having two functions; one being to purify the smoke produced by cigarettes in the ashtray; and another to purify the secondary air in the area of the table.

The housing 10 includes a generally oval shaped lower portion 21, having concentrical sides extending vertically upwards, first forming an annual neck portion 20 then further extending upwards and radially outwards forming a plurality of curved petal arms 12 in the upper portion 52 of the housing 10. Each petal arm 12 having an intake port 14 defined within its outer surfaces and a conduit 15 formed by the interior surfaces of the petal arm 12. Between the upper convex surfaces 13 of the petal arms 12 are concave crevice-like depressions 45 for resting lit cigarettes 44.

Secondary air is sucked into both the intake ports 14 and through the bud openings 47 in the flowers 11. A removable prefilter 50, deposed within the bud opening of the flower 11, remove large particles. The air is then passed through the conduits 15 downwardly through the neck portion 20, then driven through a generally round sieve plate 41 that serves both to support the artificial flowers 11 and to entrap the larger sized particles. Next, the air passes through a filtration system 51 which includes: a prefiltering bed 22 containing an anti-microbial spray; next a first bed of activated charcoal 23; then a H.E.P.A. filtering system 24; and finally a second bed of activated charcoal 25 which includes an odor refreshening material. The prefilter 22 is an electrostatic air filtering means having the ability to remove up to 99 percent of 5 micron particles. This prefilter 22 will remove dirt, dust and bacteria and serves to protect the H.E.P.A. filtration system 24 and is easily cleanable. It is equally important that the device be antimicrobial to diminish any viable organisms. The activated charcoal beds 23 and 25 remove gas molecules, odors and pollutants. The H.E.P.A. filtering system 24 will remove down 5 to 0.03 microns. The airborne contaminants in a typical restaurant include bacteria (0.3–30 microns), plant spores (10–100 microns), algae spores (3+ microns), animal and human dander (15+ microns), tobacco and smoke (0.01–1.0 microns) and inside dust (0.01–20 microns). After the smoke has passed through the filtering system it is then exhausted to the room, fully refreshed and smoke free via a plurality of exhaust vents 40.

The propelling force of the secondary air is a fan means 27, comprising a plurality of radial extending propellar-type fan blades 28 which are mounted to a drive shaft 29 connected to a motor 30. In the preferred embodiment, the motor 30 is powered by batteries 32*a*, 32*b*, 32*c*, however, the device 10 could also be powered by a conventional electric motor connected to a 110–115 volt source.

At the upper portion 52 of the housing 10 is a central opening 16, which has a concentrically extending surface 17, extending longitudinally downwards to form a channel 19. The channel 19 has an open bottom 18 for artificial flowers 11. If real flowers 11 are used, then the bottom 18 will be a water tight solid surface. This serves to make the device 10 esthetically pleasant enough for use as a table centerpiece. The flowers are supported by a circular sieve plate 41.

The fan means 27 will generally be a low h.p. unit making a minimum of noise. Any vibration generated would desirably be absorbed by a removable rubber pad 37 covering the bottom of the housing 10, which also acts to support the housing 10. The rubber pad 37 will also be non-skid and lend to the device 10 an added measure of stability.

Figure 3:
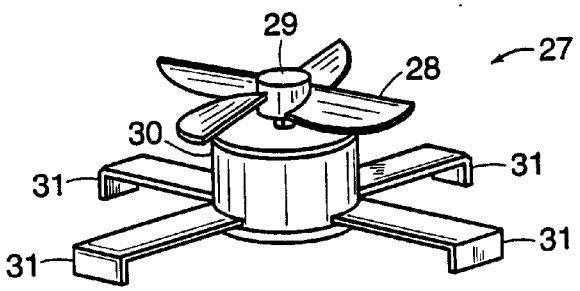
FIG. 3 is a perspective view of the fan means.

As shown in FIG. 2, the motor 30 is battery operated and is actuated by push button 36, which when depressed actuates a contact rod 35 biasing the rod 35 into contact with a conductive and removable metal sleeve 43 which in turn activates the batteries 32*a*, 32*b*, and 32*c*. The batteries 32*a*, 32*b* and 32*c* will generally be of a rechargeable type such as nickle cadmium or a similar type well known in the art. These batteries 32*a*, 32*b*, 32*c* are housed in a concentrically elongated battery support casing 33. As shown in FIGS. 2 and 3, the motor 30 is mounted in the interior of the metal sleeve 43 by means of braces 31 which are biased against the interior surface of the sleeve 43. The system is energized by means of electrical wires 34*a* and 34*b*, which complete the electrical circuit within the motor 30. The push button switch 36 is desirably mounted in a side wall of the housing as shown in FIG. 2.

All the parts of the filtering system, as is the support sieve plate 41, are positioned immediately above the fan means 27 and held in place by screens 26. The screens 26 support the filtering material 22, 23, 24 and 25, and prevent the same from escaping into the vicinity of the fan propellar blades 28. The screens 26 may have diameters just slightly greater than the inner diameter of the opening of the metal sleeve 43, so that the edges of the screens 26, which are normally somewhat sharp, are forced against the walls of the metal sleeve 43 to hold the screens 26 in place. If desired, openings may be provided within the internal surface of the of the sleeve 43 with circumferential grooves into which the edges of the screens 26 may be received.

The rubber pad 37 can be removed for the purpose of opening the housing 10. A bottom access door 49 contains a latch 38 and rotates about a hinge 39 to allow access to the interior of the lower housing 21, whereby all internal parts, including fan means 27, filtering materials 22, 23, 24, 25 and batteries 32*a*, 32*b*, 32*c* can be removed for cleaning and replacement. When the door 49 is opened the entire metal sleeve 43, which is concentrically snug-fitted within the lower housing 21, can be removed to allow access to all internal parts.

The upper portion 52 of the housing 10 has a removable ring shaped ash receptacle 42 nestled within the petal arms 12. This receptacle will gather ashes from the cigarettes 44 which are deposed within the crevices 45 formed by the petal arms 12.

Figure 4:
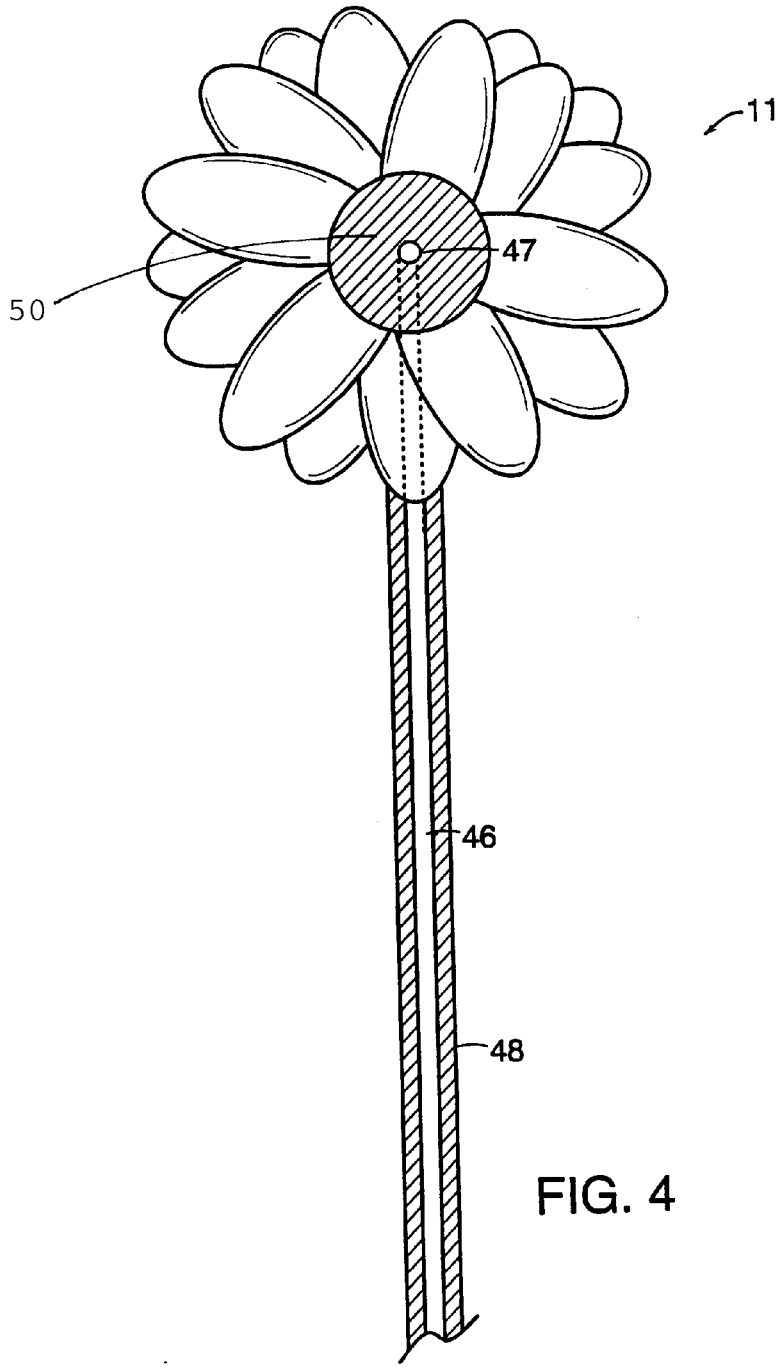
FIG. 4 is an elevational view of a typical artificial flower showing the hollow construction.

FIG. 4 shows a typical artificial flower 11 which can be used. The flower 11 will have a bud opening 47 for drawing the surrounding air into the device whereby the air will be driven through an air duct 46 extending the length of the flower stem 48. Deposed within the bud opening 47 will be a prefilter 50 for trapping larger particles than those designed to be removed by the filtration 51 system. The preferred embodiment will have a cluster of flowers 11 and the flowers 11 will be supported by the circular sieve plate 41. The flowers 11 are rigidly held in the channel 19. If real flowers are desired in lieu of the artificial flowers 11 then the channel 19 would include a water tight solid bottom 18.

Another embodiment of the invention would utilize an electrical connection comprising a double-headed adaptor means which could have one side inserted into an electrical connecting means at the bottom of the housing 10 and the other side of the adapter inserted into a plug outlet in the table. This would offer an electrical connection to 110/115 V source without the need for wires. It also would afford a certain extra measure of stability to the housing 10.

Still yet another embodiment would manufacture the housing 10 having a hollow structure whereby instead of relying on the exhaust vents 40 to return the freshened air to the area, the fresh air would recirculate through the hollow structure and exit via selected port holes 14. Adding to this embodiment would be to have selected flowers 11 acting as exhaust vehicles. This would allow for returning the freshened air at a height above where it might blow upon the food.

The device 10 can be formed by molding any suitable plastic material having the necessary mechanical strength and able to withstand the elevated temperatures that are encountered. The device can also be glass, metal, porcelain or a variety of other materials, usually colored to match a particular decor. The housing 10 is portable, cleanable and reusable.

While the system 9 disclosed herein is ideally suitable for use on a table or the like, preferably in a restaurant environment, it can be appreciated that the concept described herein could be used in a multitude of places. One such use might be to have a much larger embodiment of the system 9 placed on the floor of a room possibly connected to an electrical outlet or to an air conditioning outlet. This embodiment would maintain the same concepts, but because of its larger size would utilize ferns, bushes, trees and other like greenery to draw the air through the system 9.

It is to be appreciated that changes may be made in the construction and arrangement of the system 9 without departing from the real spirit and purpose of the invention, and it is the intention of the invention to cover by claims any modified forms of structure or use which may be reasonably included within their scope. The shape of the housing 10 is just one sample of the many vase-like shapes that can be utilized.

LEGEND

9 Pure Air Filter
10 Housing
11 Flowers
12 Petal Arm
13 Convex surface of petal arm
14 Intake ports
15 Conduit in the petal arm
16 Central opening in housing for insertion of flowers
17 Channel surface
18 Bottom of channel
19 Channel
20 Neck portion of housing
21 Lower portion of housing
22 Prefilter bed
23 First bed of Activated Carbon
24 H.E.P.A. filtering system
25 Second bed of activated carbon
26 Screens to hold filters and sieve plate
27 Fan means
28 Radial Propellar Fan Blades
29 Motor shaft
30 Motor
31 Braces
**32*a*** Battery
**32*b*** Battery
**32*c*** Battery
33 Battery support casing
**34*a*** Electrical wire connector
**34*b*** Electrical wire connector
35 Contact Rod
36 Push button switch
37 Removable rubber pad
38 Latch for securing door
39 Hinge for door to rotate open and close
40 Exhaust Vents
41 Circular sieve plate
42 Removable ash receptacle
43 Removable metal sleeve
44 Lit Cigarette at rest
45 Concave crevice between petal arms
46 Air duct in artificial flower
47 Opening in bud of flower
48 Flower stem
49 Door in bottom of housing
50 Prefilter in bud opening
51 Filtration System
52 Upper portion of housing

I claim:

1. A pure air system, presenting an appearance of an ornamental table centerpiece, comprising:

a hollow housing having an upper portion, a neck portion and a lower portion, the neck portion integrally connecting the upper and lower portions;

the upper portion having means for allowing air to be drawn into the housing;

the upper portion having defined a central opening therein;

the central opening having a cylindrical surface extending downwardly into the neck portion to form a channel thereof;

a floral arrangement having a plurality of flowers extending through the central opening and deposed within the channel;

a circular sieve plate integral with the bottom on the channel, for supporting the floral arrangement, the plate fastened within the housing by a generally circular screen biased against the internal surface of the housing;

each flower having a center bud opening for drawing in air, a removable prefilter deposed in each flower bud and a hollow stem for passing air to the system;

means supported in the lower portion for filtering and refreshening the smoke filled air;

means supported in the lower portion for propelling the smoke through the system;

means supported in the lower portion for powering the propelling means; and a plurality of exhaust vents located about the bottom of the lower portion, whereby the smoke filled air is drawn downwardly from the means in the upper portion and the center openings in the flowers, treated by the filtering means, then returned to the surrounding atmosphere clean and refreshed.

2. The pure air system according to claim 1, wherein the upper portion of the housing includes:

a plurality of curved petal arms extending outwardly from the center;

each petal arm having a hollow conduit defined by the interior surface of the arm;

the outer extremities of the petal arms defining intake ports for the passage of inhaled smoke to the system;

each arm having a convex upper surface;

adjoining arms having defined a concave crevice therebetween for holding resting cigarettes; and a removable ash receptacle covering the central opening whereby the ashes that fall from the cigarettes are captured.

3. The pure air system according to claim 2, wherein the lower portion of the housing includes:

a generally cylindrical removable metal sleeve holding from top to bottom the filtering means, the propelling means, and the power means; and a door on the bottom of the housing, a hinge mechanism for allowing the door to rotate open and closed, and a latch to secure the door shut, whereby the metal sleeve and all the contents can be removed through the door for cleaning, repairing and replacement.

4. The pure air system according to claim 3, wherein the bottom of the housing includes a removable rubber pad for protection against slippage and dampening of vibrations created by the power means.

5. The pure air system according to claim 4, wherein the filtration means includes:

an electrostatic prefiltering bed having an antimicrobial spray for the removal of dirt, dust and bacteria;

a first bed of activated carbon deposed below the prefiltering bed for removal of gas molecules, odors and pollutants;

a H.E.P.A. filtering system deposed below the first charcoal bed for removing contaminants down to 0.03 microns;

a second bed of activated carbon deposed below the H.E.P.A. filtering system having contained therein an odor refreshening material;

each of the four beds supported within the sleeve by a circular screen, the screens having diameters slightly larger than the diameter of the sleeve, whereby the screens are tightly biased against the inner surface of the sleeve.

6. The pure air system according to claim 5, wherein the propelling means includes:

a motor having a drive shaft;

a plurality of radial propellar fan blades rotatively connected to the drive shaft; and a plurality of braces extending outwardly from the motor, each brace biasing against the inner surface of the sleeve to support the motor and fan blades below the filtering system, whereby the smoke is propelled downwardly through the system.

7. The pure air system according to claim 6, wherein the powering means includes:

a generally cylindrical battery casing biased between the inner surface of the removable metal sleeve below the propelling means;

a plurality of batteries deposed in series within the battery casing;

a pair of electrical wire connectors, one connector leading from the battery cathode to the motor and the other from the battery anode to the motor;

the removable sleeve being manufactured from a highly conductive metal;

a contact rod interposed between the surface of the housing and the surface of the conductive sleeve; and a push button switch positioned on the exterior of the housing, whereby the system is energized by engaging the push button into contact with the conductive sleeve.

8. The pure air system according to claim 6, wherein the powering means is a 110/115 volt electrical connection.

9. The pure air system according to claim 8, wherein the system further presents an appearance of an ornamental floor vase having a floral arrangement selected from the group consisting of flowers, ferns, trees, bushes or shrubbery.

10. An ashtray system for capturing and substantially eliminating odors of smoke from cigarettes, the ashtray comprising:

a hollow vase-shaped housing;

a plurality of curved petal arms extending outwardly from the upper portion of the housing, each petal arm having extremities that define an intake port leading to a conduit defined by the interior surface of the petal arm, each petal arm having a convex upper surface, adjoining petal arms defining a concave crevice therebetween for holding resting cigarettes;

the upper surface of the housing having defined therein a central opening, a removable ash receptacle deposed within the opening for capturing ashes from cigarettes;

a cylindrical surface extending downward from the central opening defining therein a channel, a generally round sieve plate held in position within the neck portion of the housing by a circular spring biased between the housing internal surface;

a metal sleeve interposed in the lower portion of the housing containing a means for filtering the smoke, a means for propelling the smoke downward through the system and a means for powering the system;

a plurality of exhaust vents located below the metal sleeve;

a generally circular door positioned on the bottom of the housing, a hinge mechanism integral with the door for opening and closing, a latch for securing the door in a closed position;

a removable rubber pad covering the bottom of the housing, the pad providing resistance against slippage and also aiding the dampening of vibrations created by the powering means; and a plurality of artificial flowers, each flower having an opening in the bud section, a hollow stem leading downward from the bud, a removable prefilter deposed within the bud opening, the flowers placed within the central opening of the housing and held in position by the channel and supported by the sieve plate, whereby smoke contaminated air is drawn into the system through the intake ports of the petal arms and the bud openings of the flowers, then driven downward through the filtering means by the propelling means before being exhausted from the housing through the exhaust vents, the returned air being clean and refreshed.

11. The ashtray according to claim 10, wherein the filtering means includes:

an electrostatic prefiltering bed having an antimicrobial spray for removal of dirt, dust and bacteria;

a first bed of activated carbon deposed below the prefiltering bed, for the removal of gas molecules, odors and pollutants;

a H.E.P.A. filtering system, deposed below the first carbon bed, for removing contaminants down to 0.03 microns;

a second bed of activated carbon, deposed below the H.E.P.A. system, the bed including an odor refreshening material; and support springs for supporting the individual beds within the metal sleeve.

12. The ashtray according to claim 11, wherein the propelling means includes;

a motor having a drive shaft;

a plurality of radial propellar fan blades rotatively connected to the drive shaft; and a plurality of braces extending outwardly from the motor, the extremities of the braces biasing against the sleeve surface thereby supporting the motor slightly below the filtering means.

13. The ashtray according to claim 12, wherein the power means includes;

a generally cylindrical battery casing interposed within the sleeve, a plurality of in series batteries contained within the casing;

a pair of electrical wire connectors, one connecting the negative cathode of the battery to the motor, the other connecting the positive anode of the battery to the motor;

a contact rod; and a push button switch located in the exterior of the housing, whereby the operator can energize the system by engaging the push button thereby biasing the contact rod into making an electrical connection with the metal surface of the sleeve.

14. The ashtray according to claim 12, wherein the powering means includes a connection to a 110/115 volt power outlet.

15. The ashtray according to claim 14, wherein the system further presents the appearance of a floor urn having a floral arrangement selected from the group consisting of flowers, ferns, trees, bushes or shrubbery.

* * * * *